US011486615B2

(12) United States Patent
Huang et al.

(10) Patent No.: US 11,486,615 B2
(45) Date of Patent: Nov. 1, 2022

(54) FLOW BALANCER AND EVAPORATOR HAVING THE SAME

(71) Applicant: Carrier Corporation, Jupiter, FL (US)

(72) Inventors: Xinghua Huang, Shanghai (CN); Keli Dong, Shanghai (CN); Hsihua Li, Huntersville, NC (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 399 days.

(21) Appl. No.: 16/498,867

(22) PCT Filed: Mar. 29, 2018

(86) PCT No.: PCT/US2018/025051
§ 371 (c)(1),
(2) Date: Sep. 27, 2019

(87) PCT Pub. No.: WO2018/183619
PCT Pub. Date: Oct. 4, 2018

(65) Prior Publication Data

US 2020/0056817 A1 Feb. 20, 2020

(30) Foreign Application Priority Data

Mar. 31, 2017 (CN) ..... 201710207825.4

(51) Int. Cl.
*F25B 39/02* (2006.01)
*F28D 7/16* (2006.01)
*F28D 21/00* (2006.01)

(52) U.S. Cl.
CPC ..... *F25B 39/028* (2013.01); *F28D 7/16* (2013.01); *F25B 2500/07* (2013.01); *F28D 2021/0071* (2013.01)

(58) Field of Classification Search
CPC ..... F25B 39/028; F25B 2500/07; F28D 7/16; F28D 2021/0071; F28F 2230/00; F28F 2235/00; F28F 2280/00
(Continued)

(56) References Cited

U.S. PATENT DOCUMENTS 3,257,817 A 6/1966 Leonard, Jr.
3,623,505 A * 11/1971 Barsness ..... B01J 8/0278 137/522

(Continued)

FOREIGN PATENT DOCUMENTS

CN 202613858 U 12/2012
CN 203024507 U 6/2013

(Continued)

OTHER PUBLICATIONS

"Wire Mesh Mist Eliminators"; Chem. Eng. Progress; vol. 59, No. 6, Jun. 1963; 6 pages.

(Continued)

*Primary Examiner* — Tho V Duong
*Assistant Examiner* — Raheena R Malik
(74) *Attorney, Agent, or Firm* — Cantor Colburn LLP

(57) ABSTRACT

The present invention relates to a flow balancer for an evaporator, comprising: a permeable assembly comprising at least one gas- and fluid-permeable plate and located above a heat exchange tube bundle of the evaporator; a sealing assembly disposed on a periphery of the permeable assembly and constructed to be nonpermeable to gas and fluid; and a mounting assembly constructed to support the permeable assembly and the sealing assembly. The present invention also relates to an evaporator comprising the flow balancer. The flow balancer of the present invention has the advantages of simple structure and convenient manufacturing and mounting, can balance the pressure distribution above the (Continued)

heat exchange tube bundle, and can achieve a more even distribution of the refrigerant liquid level in the length direction of the heat exchange tube bundle.

21 Claims, 2 Drawing Sheets

(58) Field of Classification Search
USPC ..... 62/527
See application file for complete search history.

(56) References Cited

U.S. PATENT DOCUMENTS

| | | | | |
|---|---|---|---|---|
| 4,630,776 | A * | 12/1986 | Findling | B01D 21/2405 239/498 |
| 4,843,837 | A | 7/1989 | Ogawa et al. | |
| 5,261,485 | A | 11/1993 | Thornton et al. | |
| 5,415,223 | A | 5/1995 | Reavis et al. | |
| 6,167,713 | B1 * | 1/2001 | Hartfield | F25B 39/028 165/160 |
| 6,293,112 | B1 | 9/2001 | Moeykens et al. | |
| 6,516,627 | B2 | 2/2003 | Ring et al. | |
| 6,532,763 | B1 | 3/2003 | Gupte | |
| 6,830,099 | B2 * | 12/2004 | Moeykens | F25B 39/028 159/13.3 |
| 6,868,695 | B1 * | 3/2005 | Dingel | F25B 39/028 165/115 |
| 7,275,394 | B2 * | 10/2007 | Lundberg | F28D 1/05391 165/DIG. 483 |
| 7,421,855 | B2 | 9/2008 | Ring et al. | |
| 7,707,850 | B2 | 5/2010 | Wang et al. | |
| 8,176,750 | B2 * | 5/2012 | Higashiyama | F28D 1/05391 62/515 |
| 8,863,551 | B2 | 10/2014 | De Larminat et al. | |
| 8,944,152 | B2 | 2/2015 | Kulankara et al. | |
| 9,366,464 | B2 | 6/2016 | Sonninen et al. | |
| 9,464,851 | B2 | 10/2016 | Provenziani | |
| 9,631,871 | B2 * | 4/2017 | Contet | F28F 9/0224 |
| 9,714,601 | B2 * | 7/2017 | Masuda | F01P 11/028 |
| 10,132,537 | B1 * | 11/2018 | Stamp | F25B 39/00 |
| 2007/0107886 | A1 | 5/2007 | Chen | |
| 2008/0041096 | A1 | 2/2008 | Sakashita et al. | |
| 2009/0120627 | A1 * | 5/2009 | Beamer | F28F 9/0246 165/174 |
| 2010/0206535 | A1 * | 8/2010 | Munoz | F28F 9/0273 165/173 |
| 2011/0041528 | A1 | 2/2011 | Charbel et al. | |
| 2012/0118545 | A1 | 5/2012 | Ayub et al. | |
| 2013/0112381 | A1 * | 5/2013 | Valente | F28F 9/0278 165/159 |
| 2014/0311721 | A1 | 10/2014 | Esformes et al. | |
| 2015/0013951 | A1 * | 1/2015 | Numata | F28D 3/02 165/157 |
| 2015/0153115 | A1 | 6/2015 | Kayser et al. | |
| 2017/0138652 | A1 * | 5/2017 | Hattori | F25B 39/02 |
| 2017/0153061 | A1 * | 6/2017 | Yoshioka | F25B 39/02 |
| 2017/0254573 | A1 * | 9/2017 | Numata | F25B 39/00 |

FOREIGN PATENT DOCUMENTS

| | | | |
|---|---|---|---|
| CN | 203090747 | U | 7/2013 |
| CN | 203298544 | U | 11/2013 |
| CN | 203572114 | U | 4/2014 |
| CN | 203908141 | U | 10/2014 |
| CN | 205690379 | U | 11/2016 |
| CN | 106440547 | A | 2/2017 |
| DE | 102013010510 | A1 | 3/2014 |
| EP | 2365269 | A1 | 9/2011 |
| FR | 2976828 | A1 | 12/2012 |
| JP | 2002333236 | A | 11/2002 |
| JP | 2002349999 | A | 12/2002 |
| JP | 2004100985 | A | 4/2004 |
| JP | 2008138891 | A | 6/2008 |
| WO | 2006064823 | A1 | 6/2006 |
| WO | 2010002343 | A1 | 1/2010 |

OTHER PUBLICATIONS

International Search Report and Written Opinion for application PCT/US2018/025051, dated Jun. 14, 2018, 13 pages.

* cited by examiner

FLOW BALANCER AND EVAPORATOR HAVING THE SAME

TECHNICAL FIELD

The present invention relates to the refrigeration or air conditioning field, and more specifically, to a flow balancer for a flooded evaporator and an evaporator having same.

BACKGROUND ART

It is known that a flooded evaporator is provided with one or more tube bundles or heat exchange tubes for guiding water, and the refrigerant exchanges heat with water in the tube bundle when flowing through the flooded evaporator. However, in an existing flooded evaporator, the refrigerant usually carries a large amount of liquid due to low pressure at the suction inlet, leading to a reduced Liquid Carryover (LCO) Limit of the evaporator. In addition, uneven pressure distribution may be formed above the bundle or the heat exchange tube, resulting in uneven refrigerant liquid level distribution in the length direction of the tube bundle or the heat exchange tube, and increasing the amount of refrigerant required for covering all the heat exchange tubes.

To avoid the above problems, a commonly adopted measure in the art is to increase the size of the evaporator. However, this increases the costs of the evaporator, and cannot solve the problem of uneven refrigerant liquid level in the length direction of the heat exchange tube.

Therefore, it is necessary to provide an improved evaporator to solve at least one of the above problems.

SUMMARY OF THE INVENTION

One objective of the present invention is to provide a flow balancer for use in a flooded evaporator, to balance the pressure distribution above the heat exchange tube bundle and achieve a more even distribution of the refrigerant liquid level in the length direction of the heat exchange tube bundle. Another objective of the present invention is to provide an evaporator comprising the flow balancer.

The objectives of the present invention are achieved by using the following technical solutions:

A flow balancer for an evaporator, comprising:

a permeable assembly comprising at least one gas- and fluid-permeable plate and located above a heat exchange tube bundle of the evaporator;

a sealing assembly disposed on a periphery of the permeable assembly and constructed to be nonpermeable to gas and fluid; and a mounting assembly constructed to support the permeable assembly and the sealing assembly.

Optionally, the permeable assembly comprises a first plate, a second plate, and a first steel angle member for spacing the first plate apart from the second plate, the second plate being disposed on the first plate and spaced apart from the first plate at a first distance.

Optionally, the first plate and the second plate are provided with a plurality of circular, elliptical, triangular, or polygonal through holes.

Optionally, the through holes on the first plate and the second plate are constructed to be at least partially staggered from each other in a vertical direction.

Optionally, the through holes on the first plate and the second plate are constructed to be completely staggered from each other in a vertical direction.

Optionally, the first plate and/or the second plate are/is constructed to form a flat plate cross-section, an inclined plate cross-section, a V-shaped cross-section, or an inverted V-shaped cross-section with respect to a horizontal plane.

Optionally, a reinforcing rib is disposed between the first plate and/or the second plate, and the first steel angle member is disposed at an edge of the first plate and the second plate.

Optionally, the first plate and the second plate are each provided with a plurality of positioning bolts for determining relative positions of the first plate and the second plate during mounting.

Optionally, the first plate and/or the second plate are/is constructed to have a porosity of 20%-40%.

Optionally, when the through holes are circular, the first distance is constructed to be 50%-100% of the diameter of the through hole.

Optionally, the mounting assembly comprises:

a plurality of mounting stages, each having one end constructed to be attached to an inlet distributor of the evaporator, a second steel angle member being attached to the mounting stage; and a side plate disposed between the second steel angle member and the first plate, so that the first plate is spaced apart from the heat exchange tube at a second distance.

Optionally, the second distance is constructed to be 4-8 inches.

Optionally, the side plate and the second steel angle member, the side plate and the first plate, and the second steel angle member and the mounting stage are fixed in place by welding.

Optionally, the sealing assembly comprises a strip member, having an inner circumference linked to the mounting assembly and an outer circumference constructed to be adapted to attach to an inner wall of the evaporator.

Optionally, the permeable assembly further comprises a third plate disposed above the second plate and spaced apart from the second plate at a third distance.

Optionally, the first distance and the third distance are constructed to be the same or different.

Optionally, the third plate is spaced apart from the second plate by a third steel angle member at an edge of the third plate.

An evaporator, comprising the flow balancer.

Optionally, a plurality of heat exchange tubes fixed to the mounting stage are disposed at the bottom of the evaporator.

Optionally, the mounting assembly is constructed to be fixed to the inner wall of the evaporator.

Optionally, the size of the permeable assembly is constructed to be 20-40 inches longer than the diameter of an outlet of the evaporator in a length direction, the outlet being provided at the top of the evaporator.

The flow balancer and the evaporator of the present invention have the advantages of simple structure and convenient manufacturing and mounting, can balance the pressure distribution above the heat exchange tube bundle, and can achieve a more even distribution of the refrigerant liquid level in the length direction of the heat exchange tube bundle.

BRIEF DESCRIPTION OF THE DRAWINGS

The present invention will be further described in detail in conjunction with the following accompanying drawings and preferred embodiments. However, It should be understood by one skilled in the art that the drawings are designed solely for the purpose of illustrating the preferred embodiments and should not be considered as a limitation to the scope of the present invention. It should be further understood that the drawings are not necessarily drawn to scale and that, unless otherwise indicated, they are merely intended to conceptually illustrate compositions or structures of objects described herein and may include exaggerated indications.

DETAILED DESCRIPTION

Figure 1:
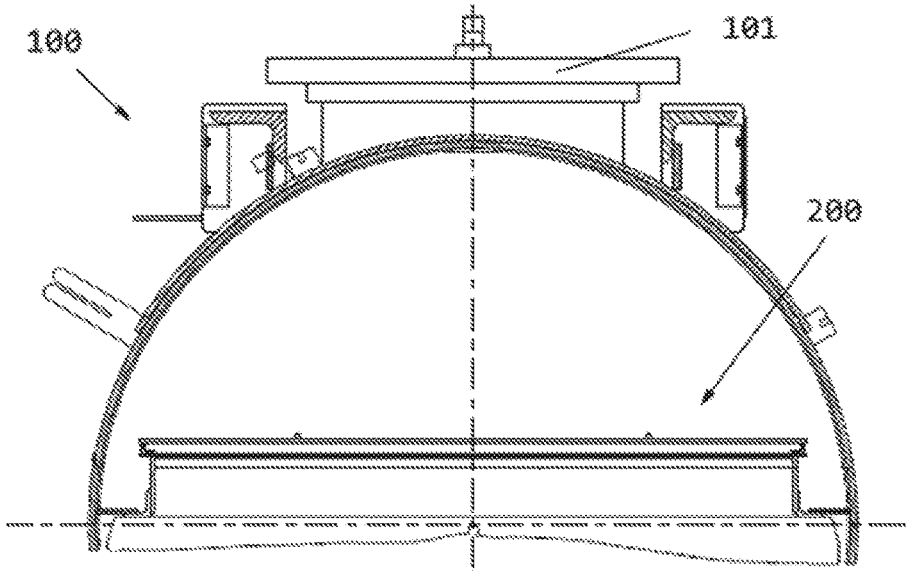
FIG. 1 is a partial cross-sectional view of an embodiment of an evaporator according to the present invention.

Preferred embodiments of the present invention will be described in detail below with reference to the accompanying drawings. It should be understood by one skilled in the art that these descriptions are illustrative and exemplary only and should not be construed as limiting the protection scope of the present invention.

First, it should be noted that orientational terms such as top, bottom, upward, and downward as used herein are relative concepts defined with respect to/relative to the directions in the accompanying drawings, and therefore may vary with different positions and different states in practice. Hence, such or other orientational terms should not be construed as limiting.

It should also be noted that for any single technical feature described or implied in the embodiments of the present invention or any single technical feature shown or implied in the accompanying drawings, such technical features (or their equivalents) can still be combined with each other to obtain other embodiments of the present invention that are not directly mentioned herein.

It should be noted that the same reference numerals in different drawings denote the same or approximately the same components.

FIG. 1 is a partial cross-sectional view of an embodiment of an evaporator according to the present invention. An outlet 101 is provided at the top of the evaporator 100, and a flow balancer 200 is approximately disposed in the middle of the evaporator 100. It should be understood by one skilled in the art that although not shown in FIG. 1, a plurality of heat exchange tubes can be disposed at the lower part of the evaporator 100.

In use, the refrigerant enters the evaporator 100 from an inlet distributor (not shown, and to be described in detail below) at the lower part of the evaporator 100. By means of heat exchange with water in the heat exchange tube, some of the refrigerant converts or evaporates into gas. The gas and liquid parts of the refrigerant then continue to flow upward to pass through the flow balancer 200, leave the evaporator 100 through the outlet 101, and enter a compressor not shown.

In an existing evaporator, no flow balancer or similar means in provided. Therefore, the gas and liquid parts of the refrigerant directly flow to the upper part of the evaporator, i.e., an area where no heat exchange tube is disposed in the evaporator. Due to uneven heat exchange and the position of the outlet, the gas and liquid parts of the refrigerant in the upper part of the evaporator flow to form an uneven pressure distribution. This will lead to the formation of an uneven refrigerant pool level in the length direction of the heat exchange tube bundle. In this case, in order that the heat exchange tube is completely submerged in the refrigerant, more refrigerant needs to be introduced into the evaporator.

In the evaporator 100 shown in FIG. 1, the flow balancer 200 disposed in the evaporator 100 can effectively prevent the formation of an uneven refrigerant pool level in the length direction of the heat exchange tube bundle, thus reducing the amount of refrigerant required and improving the liquid carryover performance.

In the embodiment shown in FIG. 1, the flow balancer 200 is approximately located in the middle of the evaporator 100. However, according to actual requirements, one skilled in the art may also dispose a similar flow balancer at other position in the evaporator, including, but not limited to, the upper or lower part of the evaporator.

The flow balancer 200 can be constructed to cover the entire length of the heat exchange tube bundle or selectively cover at least part of the entire length of the heat exchange tube bundle or constructed to have a desired geometric shape.

Figure 2:
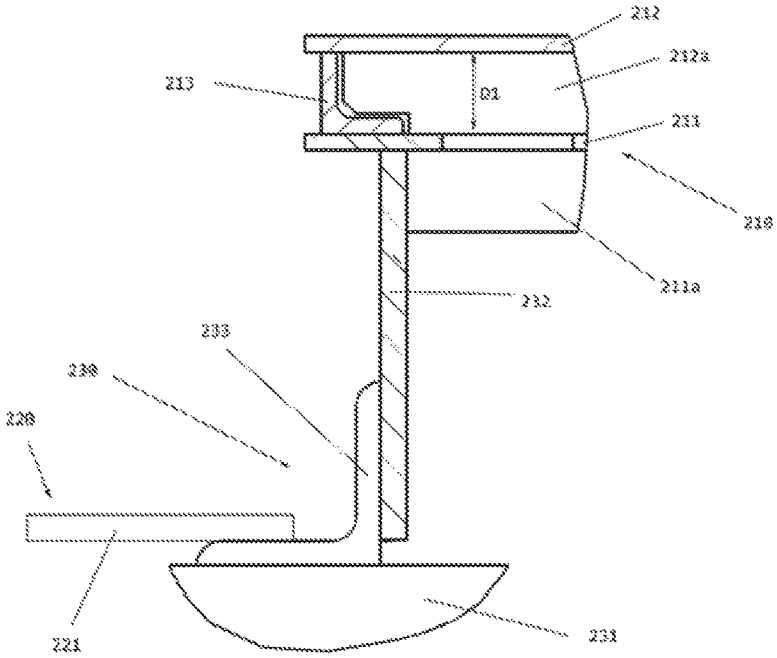
FIG. 2 is a partial enlarged view of FIG. 1.

FIG. 2 is a partial enlarged view of FIG. 1. The flow balancer 200 comprises: a permeable assembly 210, comprising at least one gas- and fluid-permeable plate and located above the heat exchange tube bundle of the evaporator 100; a sealing assembly 220 disposed on a periphery of the permeable assembly 210 and constructed to be nonpermeable to gas and fluid; and a mounting assembly 230 constructed to support the permeable assembly 210 and the sealing assembly 220.

As shown in the figure, the permeable assembly 210 comprises a first plate 211 and a second plate 212. The first plate 211 is spaced apart from the second plate 212 at a first distance D1. A first steel angle member 213 is disposed between the first plate 211 and the second plate 212.

Optionally, the first plate 211 is provided with a first reinforcing rib 211*a*, and a second reinforcing rib 212*a* is provided between the second plate 212 and the second plate 212.

In the embodiment shown in the figure, the flow balancer 200 comprises the first plate 211 and the second plate 212. However, according to actual requirements, one skilled in the art may also dispose one or more additional plates or remove one of the first plate 211 and the second plate 212. Distances between the plates may be all the same or may be completely or partially different. As the number of plates increases, a steel angle member for positioning purposes can be disposed between plates correspondingly.

It should be readily understood that an excessively large distance between plates will affect the separation of liquid and gas, and an excessively small distance will lead to a large gas flow resistance. Therefore, one skilled in the art can determine a predetermined distance between plates according to actual requirements and the detailed descriptions below.

Similarly, one skilled in the art can also set the heights of the reinforcing ribs and the sizes of the steel angle members according to actual requirements.

The mounting assembly 230 comprises: a plurality of mounting stages 231, each having one end constructed to be attached to the heat exchange tube not shown, a second steel angle member 233 being optionally attached to the mounting stage 231; and a side plate 232 disposed between the second steel angle member 233 and the first plate 211, so that the first plate 211 is spaced apart from the heat exchange tube bundle at a second distance.

Optionally, the second distance is constructed to be 4-8 inches.

Optionally, the side plate 232 and the second steel angle member 233, the side plate 232 and the first plate 211, and the second steel angle member 233 and the mounting stage 231 are fixed in place by welding. According to actual requirements, other attachment means such as bolt connection, threaded connection, bonding, and integral forming can also be adopted.

The sealing assembly 220 comprises a strip member 221, having an inner circumference linked to the mounting assembly 230 and an outer circumference constructed to be adapted to attach to an inner wall of the evaporator 100. The sealing assembly 220 is constructed to prevent the gas and liquid parts of the refrigerant from passing through a gap between the heat exchange tube bundle and the inner side of the housing of the evaporator. Optionally, the strip member 221 may be a blocking strip or strip-shaped object for preventing the refrigerant from flowing therethrough.

The flow balancer 200 may be disposed on the heat exchange tube bundle to balance the pressure above the heat exchange tube bundle and achieve a more even distribution of the refrigerant liquid level in the length direction of the heat exchange tube bundle.

Figure 3:
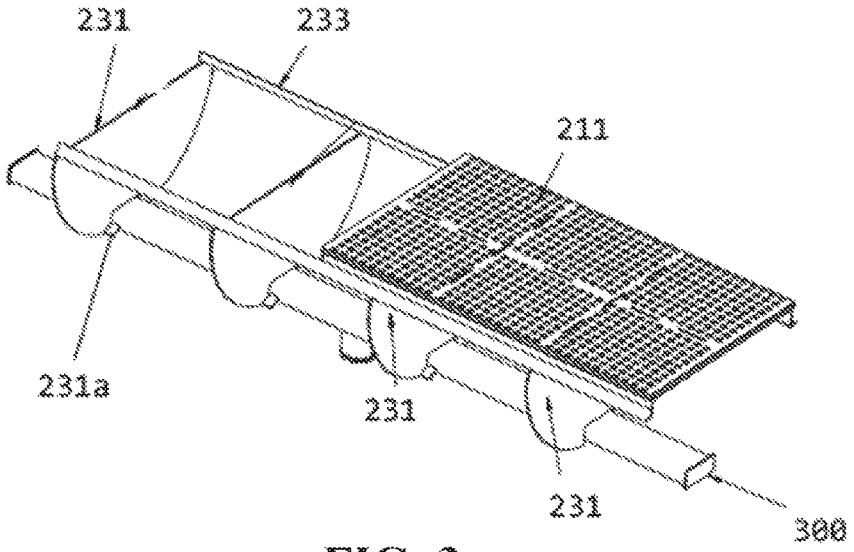
FIG. 3 is a stereo view of an embodiment of a flow balancer according to the present invention.

FIG. 3 is a stereo view of an embodiment of a flow balancer according to the present invention. As shown in the figure, the plurality of mounting stages 231 are attached to an inlet distributor 300, and the plurality of mounting stages 231 assists the mounting assembly in supporting the first plate 211. For clarity, part of the first plate 211 is not shown so as to show the shapes of the mounting stage 231 and the second steel angle member 233. Similarly, the heat exchange tube bundle located between the inlet distributor 300 and the first plate 211 is also not shown so as to show the shape of the inlet distributor 300.

It should be readily understood that the inlet distributor 300 may be provided with a plurality of holes not shown, to distribute the refrigerant in the vertical direction. The heat exchange tube bundle not shown is disposed between the inlet distributor 300 and the first plate 211. When the refrigerant flows upward, the refrigerant will first exchange heat with the heat exchange tube bundle not shown, and then continue to move upward to flow through the first plate 211.

In the embodiment shown in the figure, four mounting stages 231 are used for supporting the first plate 211. However, one skilled in the art may also dispose more or fewer mounting stages 231 according to actual requirements. It should be readily understood that the mounting stage 231 can also be used to support the heat exchange tube bundle not shown.

Optionally, the mounting assembly 230 may also be constructed to be directly attached to a housing of a heat exchanger.

Optionally, the inlet distributor 300 may be made of steel.

Optionally, one or more fixing portions 231*a* for assisting in fixing of the mounting stage 231 may be disposed at the junction between the mounting stage 231 and the inlet distributor 300.

Figure 4A:
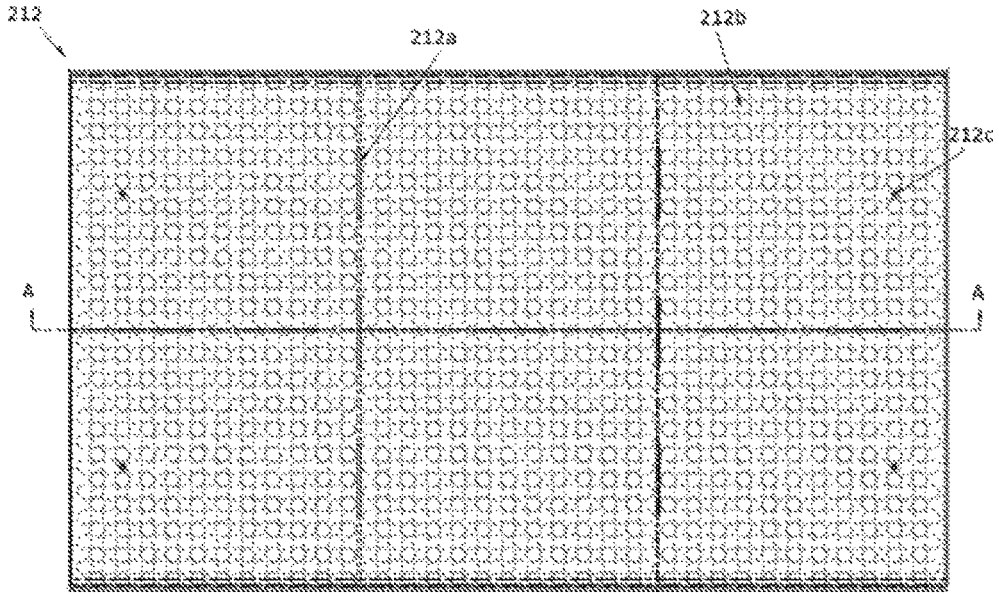
FIG. 4*a* is a top view of a plate in the embodiment shown in FIG. 3.

FIG. 4*a* is a top view of a plate in the embodiment shown in FIG. 3. The second plate 212 is approximately in the shape of a flat plate. The second plate 212 is provided with a plurality of holes 212*b*, and a plurality of reinforcing ribs 212*a* are disposed between the first plate 211 and the second plate 212.

Optionally, the reinforcing ribs 212*a* may be arranged according to actual requirements to form a particular topological shape, including, but not limited to, triangular, rectangular, hexagonal, etc. The reinforcing ribs 212*a* may be in a segmented form according to actual requirements.

Optionally, the size of the plurality of holes 212*b* on the second plate 212 is set so that the total porosity is 20%-40%.

Optionally, the gas-permeable structure on the plate is not limited to circular holes shown in FIG. 4*a*, and may be through holes in other suitable shapes, including, but not limited to, groove, slit, equilateral polygon, irregular polygon, ellipse, triangle, etc.

Optionally, the distance between plates may be constructed to be 0.5-1 times the diameter of the hole. Similarly, in the embodiment shown in the figure, all the holes on the plate have the same diameter. However, holes having different diameters may also be formed on one plate according to actual requirements. Such holes having different diameters may be provided continuously or at intervals as required.

Optionally, when a plurality of plates are disposed, holes on one plate may be constructed to be staggered form holes on another plate, to prevent the liquid from directly flowing through the plates quickly. Such a construction facilitates the separation of liquid and gas, thereby reducing liquid carryover. Dashed lines in FIG. 4*a* represent holes on a lower plate. As shown in the figure, the holes on the plates are constructed to be completely staggered from each other in the embodiment shown in FIG. 4*a*.

Optionally, the distance from the plate closest to the heat exchange tube bundle to the heat exchange tube may be constructed to be about 4-8 inches. In the embodiment shown in the figure, the first plate 211 is the closest to the heat exchange tube bundle.

Optionally, the sizes of the plates are constructed to be 20-40 inches longer than the diameter of the outlet 101 in the length direction, so as to effectively adjust the flow of liquid and gas.

Figure 4B:
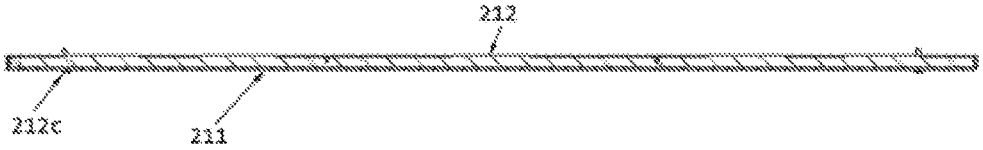
FIG. 4*b* is a cross-sectional view taken along line A-A in FIG. 4*a*.

FIG. 4*b* is a cross-sectional view taken along line A-A in FIG. 4*a*. The reinforcing rib 212*a* is disposed between the first plate 211 and the second plate 212, and the reinforcing rib 212*a* may be discontinuous at some positions.

Optionally, the first plate 211 and the second plate 212 may each be further provided with a plurality of positioning bolts 212*c* for determining relative positions of the first plate 211 and the second plate 212 during mounting. In the embodiment shown in the figure, a total of four positioning bolts 212*c* are disposed.

In the embodiments described above, the plate is constructed to have a planar structure. However, the plate may also be constructed into other shapes according to actual requirements. The plate of the flow balancer may be constructed to form a flat plate cross-section, a V-shaped cross-section, an inverted V-shaped cross-section, or an inclined plate cross-section with respect to/relative to the horizontal plane, and plates having different shapes can be used in combination during mounting. For example, a plate at the top may be a V-shaped plate, and another plate below the plate may be a flat plate.

The flooded evaporator of the present invention can be disposed in a refrigeration unit together with a heat exchanger, to provide heat exchange between the refrigerant and water. It should be understood by one skilled in the art that the flooded evaporator of the present invention can also be applied to other expected occasions. If needed, the flow balancer of the present invention can also be applied to other occasions than the flooded evaporator.

This written description refers to the accompanying drawings to disclose the present invention, and also to enable one of ordinary skill in the art to practice the present invention, including making and using any devices or systems and selecting appropriate materials and performing any incorporated methods. The patentable scope of the present invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

The invention claimed is:

1. A flow balancer for an evaporator, comprising:

a permeable assembly comprising at least one gas- and fluid-permeable plate and located above a heat exchange tube bundle of the evaporator;

a sealing assembly disposed on a periphery of the permeable assembly and constructed to be nonpermeable to gas and fluid; and a mounting assembly constructed to support the permeable assembly and the sealing assembly;

wherein the sealing assembly comprises a strip member, having an inner circumference linked to the mounting assembly and an outer circumference constructed to be adapted to attach to an inner wall of the evaporator.

2. The flow balancer according to claim 1, wherein the permeable assembly comprises a first plate, a second plate, and a first steel angle member for spacing the first plate apart from the second plate, the second plate being disposed on the first plate and spaced apart from the first plate at a first distance.

3. The flow balancer according to claim 2, wherein the first plate and the second plate are provided with a plurality of circular, elliptical, triangular, or polygonal through holes.

4. The flow balancer according to claim 3, wherein the through holes on the first plate and the second plate are constructed to be at least partially staggered from each other in a vertical direction.

5. The flow balancer according to claim 3, wherein the through holes on the first plate and the second plate are constructed to be completely staggered from each other in a vertical direction.

6. The flow balancer according to claim 2, wherein the first plate and/or the second plate are/is constructed to form a flat plate cross-section, an inclined plate cross-section, a V-shaped cross-section, or an inverted V-shaped cross-section with respect to a horizontal plane.

7. The flow balancer according to claim 2, wherein a reinforcing rib is disposed between the first plate and/or the second plate, and the first steel angle member is disposed at an edge of the first plate and the second plate.

8. The flow balancer according to claim 2, wherein the first plate and the second plate are each provided with a plurality of positioning bolts for determining relative positions of the first plate and the second plate during mounting.

9. The flow balancer according to claim 3, wherein the first plate and/or the second plate are/is constructed to have a porosity of 20%-40%.

10. The flow balancer according to claim 3, wherein the first distance is constructed to be 50%-100% of the diameter of the through hole.

11. The flow balancer according to claim 2, wherein the mounting assembly comprises:

a plurality of mounting stages, each having one end constructed to be attached to an inlet distributor of the evaporator, a second steel angle member being attached to the mounting stage; and a side plate disposed between the second steel angle member and the first plate, so that the first plate is spaced apart from the heat exchange tube at a second distance.

12. The flow balancer according to claim 11, wherein the second distance is constructed to be 4-8 inches.

13. The flow balancer according to claim 11, wherein the side plate and the second steel angle member, the side plate and the first plate, and the second steel angle member and the mounting stage are fixed in place by welding.

14. The flow balancer according to claim 2, wherein the permeable assembly further comprises a third plate disposed above the second plate and spaced apart from the second plate at a third distance.

15. The flow balancer according to claim 14, wherein the first distance and the third distance are constructed to be the same or different.

16. The flow balancer according to claim 14, wherein the third plate is spaced apart from the second plate by a third steel angle member at an edge of the third plate.

17. An evaporator, comprising the flow balancer according to claim 1.

18. The evaporator according to claim 17, wherein a plurality of heat exchange tubes fixed to the mounting stage are disposed at the bottom of the evaporator.

19. The evaporator according to claim 17, wherein the mounting assembly is constructed to be fixed to the inner wall of the evaporator.

20. The evaporator according to claim 17, wherein the size of the permeable assembly is constructed to be 20-40 inches longer than the diameter of an outlet of the evaporator in a length direction, the outlet being provided at the top of the evaporator.

21. A flow balancer for an evaporator, comprising:

a permeable assembly comprising at least one gas- and fluid-permeable plate and located above a heat exchange tube bundle of the evaporator;

a sealing assembly disposed on a periphery of the permeable assembly and constructed to be nonpermeable to gas and fluid; and a mounting assembly constructed to support the permeable assembly and the sealing assembly;

wherein the permeable assembly comprises a first plate, a second plate, and a first steel angle member for spacing the first plate apart from the second plate, the second plate being disposed on the first plate and spaced apart from the first plate at a first distance wherein the mounting assembly comprises:

a plurality of mounting stages, each having one end constructed to be attached to an inlet distributor of the evaporator, a second steel angle member being attached to the mounting stage; and a side plate disposed between the second steel angle member and the first plate, so that the first plate is spaced apart from the heat exchange tube at a second distance wherein the sealing assembly comprises a strip member, having an inner circumference linked to the mounting assembly and an outer circumference constructed to be adapted to attach to an inner wall of the evaporator.

* * * * *